US006496151B1

(12) United States Patent
Ferreri et al.

(10) Patent No.: US 6,496,151 B1
(45) Date of Patent: Dec. 17, 2002

(54) END-FIRE CAVITY SLOT ANTENNA ARRAY STRUCTURE AND METHOD OF FORMING

(75) Inventors: Arnold L. Ferreri, Hicksville, NY (US); Dominic Anton, Smithtown, NY (US); Leonard Poveromo, Northport, NY (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/933,595

(22) Filed: Aug. 20, 2001

(51) Int. Cl.[7] ..... H01Q 1/28; H01Q 13/10
(52) U.S. Cl. ..... 343/708; 343/770
(58) Field of Search ..... 343/705, 708, 343/767, 770, 771

(56) References Cited

U.S. PATENT DOCUMENTS

| | | | | | |
|---|---|---|---|---|---|
| 3,633,207 | A | | 1/1972 | Ingerson et al. | 343/770 |
| 3,982,215 | A | * | 9/1976 | Lo et al. | 333/73 |
| 4,334,229 | A | * | 6/1982 | Boblett | 343/767 |
| 4,710,775 | A | | 12/1987 | Coe | 343/727 |
| 5,344,696 | A | | 9/1994 | Hastings et al. | 428/220 |
| 5,384,185 | A | | 1/1995 | Bovenschen et al. | 428/235 |
| 5,439,746 | A | | 8/1995 | Suzuki | 428/415 |
| 5,446,471 | A | | 8/1995 | Chung et al. | 343/770 |
| 5,648,786 | A | | 7/1997 | Chung et al. | 343/770 |
| 5,714,962 | A | * | 2/1998 | Josefsson | 343/771 |
| 5,771,027 | A | | 6/1998 | Marks et al. | 343/912 |
| 5,837,739 | A | | 11/1998 | Nowak et al. | 521/54 |
| 5,872,542 | A | | 2/1999 | Simons et al. | 343/700 |
| 5,900,843 | A | * | 5/1999 | Lee | 343/767 |
| 5,914,283 | A | | 6/1999 | Yamada et al. | 442/117 |
| 5,990,844 | A | * | 11/1999 | Dumont et al. | 343/770 |

* cited by examiner

*Primary Examiner*—Don Wong
*Assistant Examiner*—Hoang Nguyen
(74) *Attorney, Agent, or Firm*—Baker Botts L.L.P.

(57) ABSTRACT

According to one embodiment of the invention, an end-fire cavity slot antenna array structure includes an upper skin formed from a composite material corresponding to a outer surface of an aircraft wing a lower skin formed from a composite material corresponding to a portion of an inner surface of the aircraft wing and a plurality of proximately positioned electrically conductive elements disposed between the upper and lower skins. Each electrically conductive element is formed from at least one sheet of composite material having an electrically conductive surface, and the sheet of composite material is configured such that the electrically conductive surface defines an inside surface of the electrically conductive element and any outside surfaces of the electrically conductive element that are in contact with an adjacent electrically conductive element.

15 Claims, 4 Drawing Sheets

END-FIRE CAVITY SLOT ANTENNA ARRAY STRUCTURE AND METHOD OF FORMING

TECHNICAL FIELD OF THE INVENTION

This invention relates generally to the field of antennas and, more specifically, to an end-fire cavity slot antenna array structure and method of forming.

BACKGROUND OF THE INVENTION

Many type of antennas are in use today in aircraft. One such type of antenna is referred to as an end-fire cavity slot antenna array. An end-fire cavity slot antenna array typically includes a plurality of antenna elements having cavity slots that radiate radio frequency waves in the longitudinal direction of the slots. When used in an aircraft, an end-fire cavity slot antenna array structure is generally positioned on the wing. Because aerodynamic performance is important during the flight of an aircraft, these antennas and other antennas in use on aircraft are typically placed in radomes. These radomes consist of a radio frequency transparent shell so that the antenna is able to function properly, while maintaining sufficient aerodynamic properties for the aircraft. However, the parasitic nature of radomes, in which a shell or other housing is placed on an aircraft wing prevents aircraft designers from realizing improved aerodynamic conditions.

SUMMARY OF THE INVENTION

According to one embodiment of the invention, an end-fire cavity slot antenna array structure includes an upper skin formed from a composite material corresponding to a outer surface of an aircraft wing a lower skin formed from a composite material corresponding to a portion of an inner surface of the aircraft wing and a plurality of proximately positioned electrically conductive elements disposed between the upper and lower skins. Each electrically conductive element is formed from at least one sheet of composite material having an electrically conductive surface, and the sheet of composite material is configured such that the electrically conductive surface defines an inside surface of the electrically conductive element and any outside surfaces of the electrically conductive element that are in contact with an adjacent electrically conductive element.

According to another embodiment of the invention, a method of forming an end-fire cavity slot antenna array structure includes providing a plurality of tooling mandrels and forming a plurality of electrically conductive elements around the tooling mandrels. The electrically conductive elements are formed from at least one sheet of composite material having an electrically conductive surface configured such that the electrically conductive surface defines an inside surface of the electrically conductive element and any outside surfaces of the electrically conductive element that are in contact with an adjacent electrically conductive element. The method further includes positioning the electrically conductive elements proximate one another, disposing the electrically conductive elements between an upper skin and a lower skin, and curing the electrically conductive elements and the upper and lower skins.

Embodiments of the invention provide a number of technical advantages. Embodiments of the invention may include all, some, or none of these advantages. An end-fire cavity slot antenna array structure is provided that is load-bearingand conforms to the aerodynamic surface of an aircraft, which helps improve aerodynamic performance. A conformal antenna array structure eliminates the need for a radome. An end-fire cavity slot antenna array structure is formed form composite material such that a reflective surface exists on the inside surface of each electrically conductive element and an electrically conductive surface exists on the outside surface of the sides of the conductive elements so that a electrically conductive path exists between elements. Forming such a structure from such composite material results in structural continuity as well as radio frequency continuity.

Other technical advantages are readily apparent to one skilled in the art from the following figures, descriptions, and claims.

BRIEF DESCRIPTION OF THE DRAWINGS

For a more complete understanding of the invention, and for further features and advantages, reference is now made to the following description, taken in conjunction with the accompanying drawings, in which.

DETAILED DESCRIPTION OF EXAMPLE EMBODIMENTS OF THE INVENTION

Example embodiments of the present invention and their advantages are best understood by referring now to FIGS. 1 through 4 of the drawings, in which like numerals refer to like parts.

Figure 1:
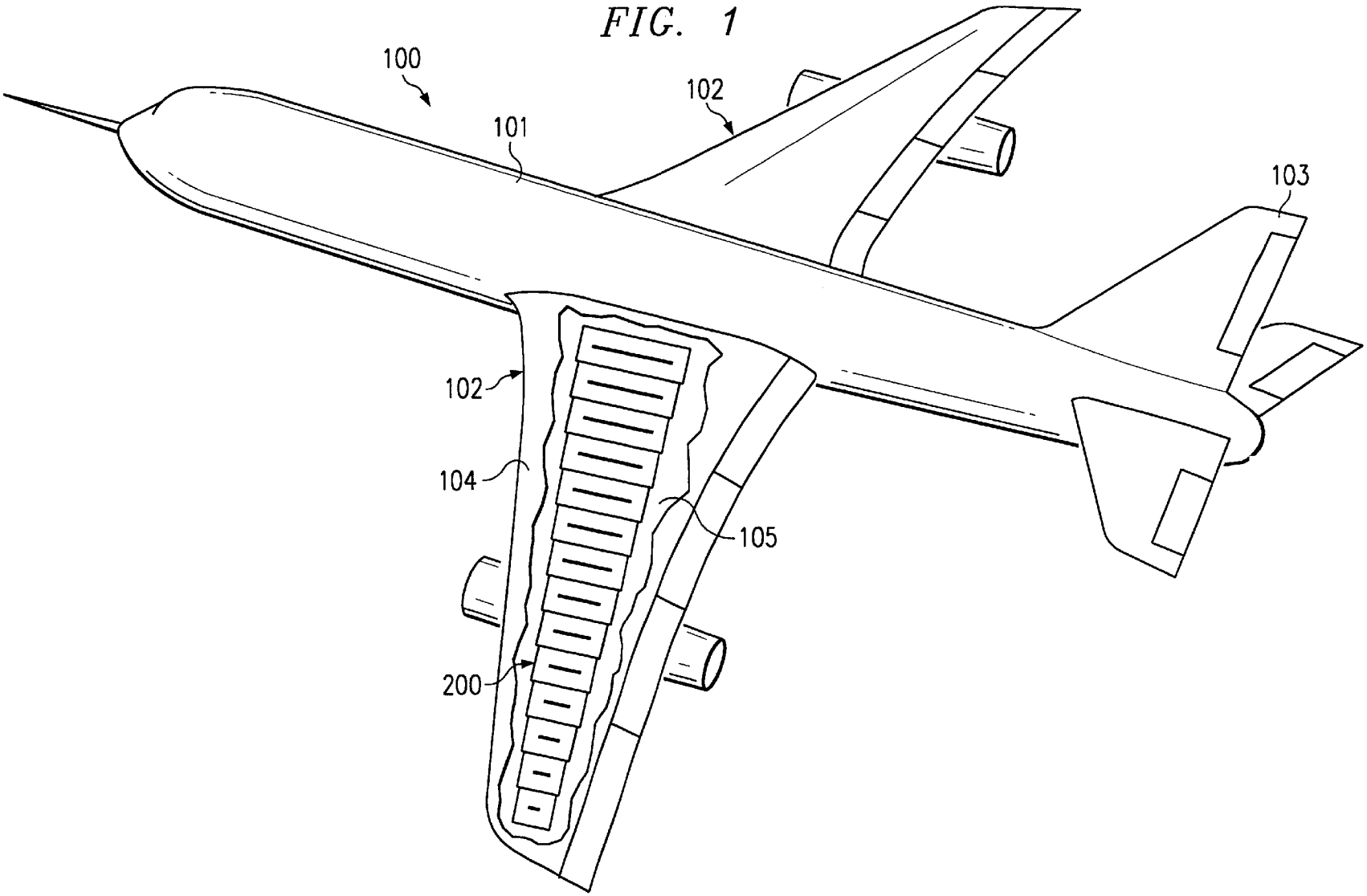
FIG. 1 is a perspective view of an aircraft having an end-fire cavity slot antenna array structure according to one embodiment of the present invention.

FIG. 1 is a perspective view of an aircraft 100 having a fuselage 101 and a pair of wings 102. Aircraft 100 is any suitable aircraft, such as an unmanned air vehicle, a fighter aircraft, or a passenger airplane. In the illustrated embodiment, a portion of an upper skin 104 of wing 102 comprises an end-fire cavity slot antenna array structure 200. In other embodiments, array structure 200 may be a portion of a lower skin 105 of wing 102, a portion of fuselage 101, a portion of a tail section 103, or other suitable locations on aircraft 100.

According to the teachings of one embodiment of the present invention, array structure 200 forms a portion of upper skin 104 and/or lower skin 105 of wing 102. Having array structure 200 integral with upper skin 104 and/or lower skin 105 of wing 102 allows end-fire cavity slot antennas to be utilized in aircrafts without using radomes. Radomes are radio frequency transparent structures that are typically placed on the surface of aircraft wings to house antennas. Eliminating radomes results in better aerodynamic performance for aircrafts. Because array structure 200 is a portion of wing 102, array structure 200 possesses the ability to withstand aerodynamic loads during flight of aircraft 100. In addition, since array structure 200 is integral with upper skin 104 and/or lower skin 105 of wing 102, array structure 200 is built from suitable materials, such as composite materials. One embodiment of array structure 200 formed from composite materials is illustrated below with reference to FIGS. 2A and 2B.

Figure 2A:
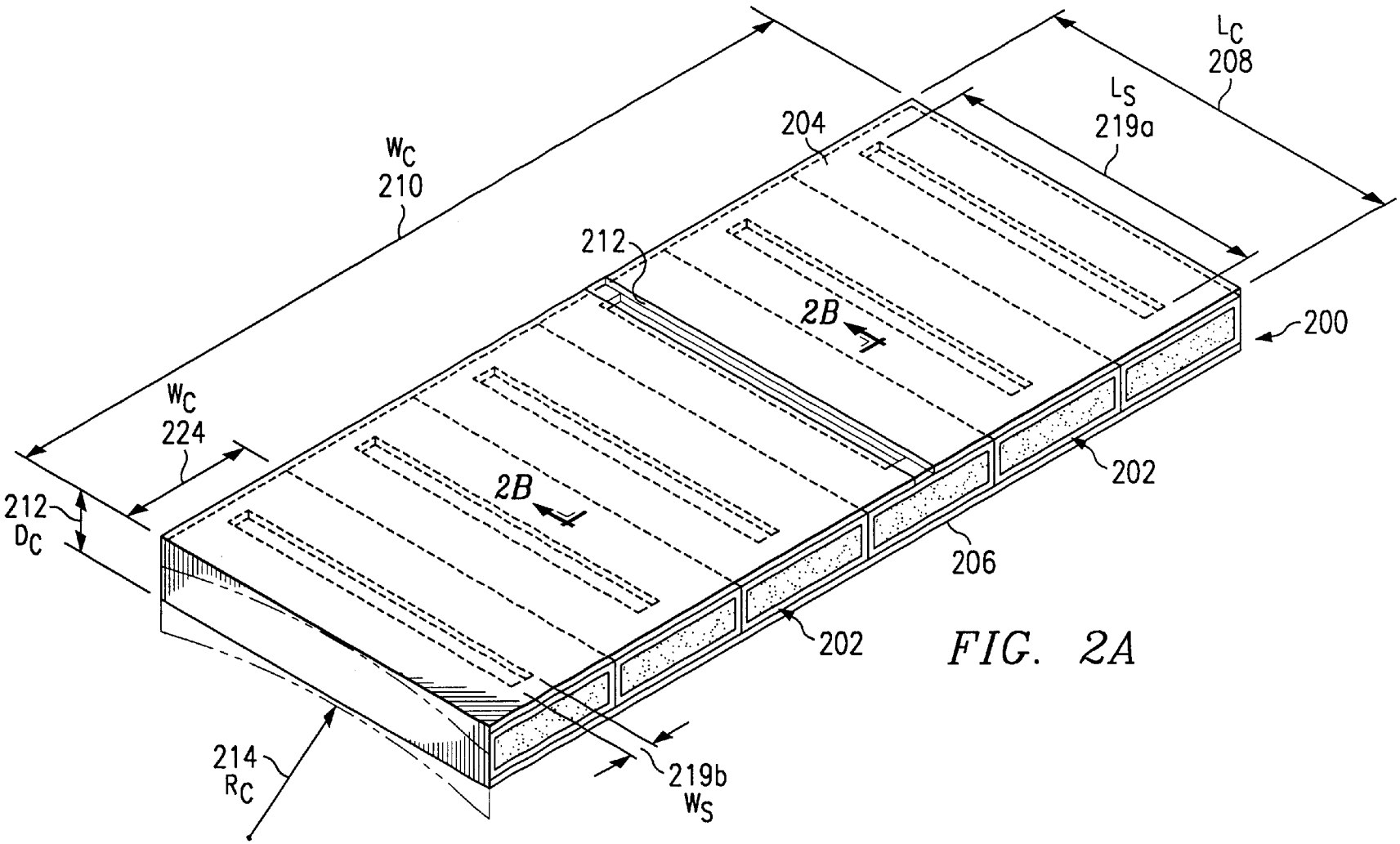
FIG. 2A is a perspective view of an end-fire cavity slot antenna array structure manufactured according to one embodiment of the present invention.

FIG. 2A is a perspective view of one embodiment of array structure 200. Array structure 200 includes a plurality of electrically conductive elements 202 disposed between an upper composite skin 204 and a lower composite skin 206. In the illustrated embodiment, array structure 200 is formed from six electrically conductive elements 202; however, array structure 200 may be formed with any suitable number of electrically conductive elements 202. Accordingly, array structure 200 may span any portion of the span of wing 102.

Array structure 200 is shown in FIG. 2A to be substantially rectangular in shape; however, array structure 200 may be formed in any suitable shape. For example, as shown in FIG. 1, array structure 200 may be formed as a series of "stepped" electrically conductive elements 202, in which the length of each electrically conductive element 202 is different. If formed in a rectangular shape, array structure 200 has a length 208, a width 210, and a depth 212. Array structure 200 may be formed with any suitable length 208, width 210, and depth 212. For example, in one embodiment, length 208 is approximately 24 inches, width 210 is approximately 240 inches, and depth 212 is approximately one inch.

Also shown in FIG. 2A, array structure 200 is substantially flat; however, as denoted by arrow 214, array structure 200 may have a curvature in one direction. In other embodiments, array structure 200 has a curvature in multiple directions. Generally, array structure 200 is formed in such a shape that it conforms to the shape of a particular section of aircraft 100. In addition, depth 212 is obtained such that it substantially corresponds with the thickness of the corresponding section of aircraft 100, such as upper skin 104 or lower skin 105 of wing 102.

Figure 2B:
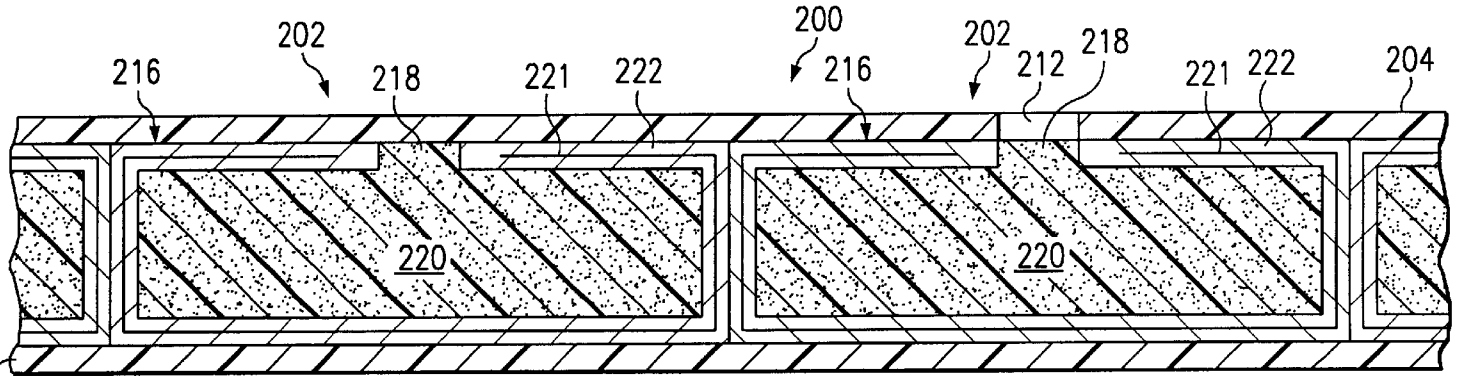
FIG. 2B is a partial cross-section of the end-fire cavity slot antenna array structure of FIG. 2A.

FIG. 2B is a partial cross section of array structure 200, showing additional details of electrically conductive elements 202. Each electrically conductive element 202 includes a body 216 having a slot 218 formed therein. Electrically conductive element 202 may also have a core 220 disposed within body 216. Electrically conductive elements 202 may have any suitable width 224 (FIG. 2A). As one example, width 224 is twelve inches.

As described in more detail below, body 216 is formed from at least one sheet 221 of composite material, having an electrically conductive surface 222, that is configured in such a way that electrically conductive surface 222 defines the inside surface of electrically conductive element 202 and the outside surfaces of the sides of electrically conductive element 202 that are in contact with an adjacent electrically conductive element 202. Any suitable material product forms may be used to obtain electrically conductive surface 222, such as metal foils, expanded perforated foils, metal mesh, or conductive mats fabricated by wrapping a carbon or fiberglass prepreg laminate core with a metal coated veil mat. If metal foil, expanded perforated foil, or metal mesh is utilized, then this product form is combined with some suitable type of matrix that can be formed into electrically conductive element 202.

Slot 218 is formed with any suitable length 219*a* and any suitable width 219*b*. The dimensions of slot 218 depend on the radio frequency requirements for array structure 200. In one example, length 219*a* is 22 inches and width 219*b* is one inch.

Core 220, in one embodiment, is any suitable type of tooling mandrel, formed from any suitable material, that is removed after the forming of body 216 and slot 218 of electrically conductive element 202. In this embodiment, core 220 provides structural stability to body 216 of electrically conductive element 202. In another embodiment, core 220 is any suitable radio frequency transparent material used to form body 216 and slot 218 of electrically conductive element 202. In this latter embodiment, core 220 is also used as a "fly-away" tooling mandrel and, accordingly, may be any suitable radio frequency transparent structural foam and/or nonmetallic honeycomb core product. For example, one such material that may be used is a Rohacell® foam. Core 220 may be any suitable shape depending on the requirements for electrically conductive elements 202.

As illustrated in FIGS. 2A and 2B, electrically conductive elements 202 are positioned proximate to one another so that adjacent sides of electrically conductive elements 202 will be in contact after array structure is formed, as described further below. Since electrically conductive surface 222 defines the outside surface of the sides of electrically conductive elements 202, an electrically conductive path will then exist between all electrically conductive elements 202. In addition, since conductive layer 222 forms the inside surface of each body 216, each electrically conductive element 202 has a reflective inside surface. The above conditions result in maintaining RF continuity of array structure 200.

Upper and lower composite skins 204 and 206 may be any suitable composite material. For example, such materials could be fiberglass, quartz, or Kevlar fibers embedded in an epoxy or cyanate ester resin matrix to produce a prepreg lamina. An important consideration with respect to upper skin 204 is that it must be formed with an RF transparent material at least in the areas existing above slot 218 so that the antenna may function more efficiently. In an embodiment where upper composite skin 204 is formed from one type of composite material, then this material should be any suitable RF transparent composite material. For example, upper composite skin 204 may be a graphite epoxy prepreg, a glass epoxy prepreg, or any other suitable composite skin formed from a low dielectric material. In another embodiment, upper composite skin 204 may be formed with a window 212 above slot 218 as shown in FIG. 2B. In this embodiment, upper composite skin 204 may be formed from any suitable composite material, such as a graphite epoxy, and have window 212 spliced therein. Window 212 would then be formed from any suitable RF transparent material, such as a glass dielectric, fiberglass, or quartz.

Now that various elements of array structure 200 have been described above, one method of forming array structure 200 is described below in conjunction with FIGS. 3A through 3C.

Figure 3B:
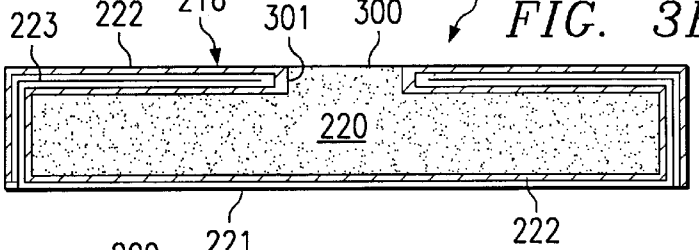
FIGS. 3A, 3B, and 3C are elevation views illustrating one method of forming an end-fire cavity slot antenna array structure.
Figure 3A:
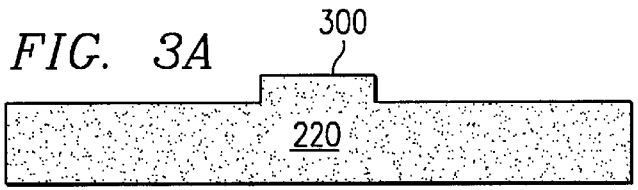
Figure 3C:
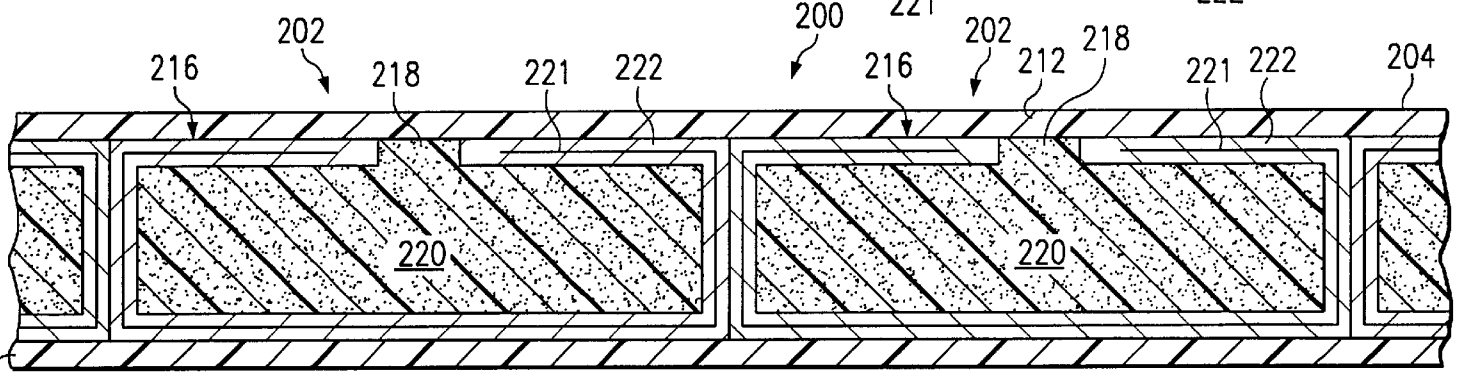

FIGS. 3A through 3C are elevation views illustrating one method of forming array structure 200. The method begins by providing core 220 as illustrated in FIG. 3A. As described above, core 220 may be any suitable shape; however, as illustrated, core 220 has a generally rectangular shape with a projection 300 used to define slot 218 of electrically conductive element 202. Again, core 220 may be any suitable RF transparent material if used as a fly-away tooling mandrel, or core 220 may be any suitable material if just used to form electrically conductive element 202 and removed thereafter.

Referring now to FIG. 3B, the forming of body 216 and slot 218 is illustrated. First, core 220 is placed on to of sheet 221 so that electrically conductive surface 222 of sheet 221 is proximate core 220. Second, sheet 221 is formed around core 220 until sheet 221 reaches projection 300 where it is then wrapped back over itself until sheet 221 at least completes the sides of electrically conductive element 202. This particular forming of sheet 221 is made possible because of the non-cured nature of sheet 221. After forming sheet 221 around core 220, the inside surface of electrically conductive element 202 is formed from electrically conductive surface 222 so that it is sufficiently reflective, and the outside surface of the sides of electrically conductive element 202 are formed from electrically conductive surface 222 so that electrically conductive elements 202 may be electrically conductive between each other. An important technical advantage of the present invention is that, in one embodiment, electrically conductive surface 222 forms sidewalls 301 of slot 218 as illustrated best in FIG. 3B. This allows array structure 200 to function more efficiently.

Each electrically conductive element 202 is formed as described above. Once the appropriate number of electrically conductive elements 202 are formed in such a manner, they are positioned proximate one another, as illustrated best in FIG. 3C.

Referring now to FIG. 3C, after positioning electrically conductive elements 202 proximate one another, upper composite skin 204 and lower composite skin 206 are laid u such that they "sandwich" electrically conductive elements 202. Any suitable composite layup technique may be used to apply upper and lower composite skins 204 and 206.

The assembly at this point in the fabrication is then placed into an autoclave and cured using any suitable composite curing techniques well known in the art of composite materials, such as vacuum bag forming. In addition, if one or more curvatures are desired to be imparted to array structure 200, then suitable measures are taken during this curing process. The curing process "sets" all composite materials used in array structure 200. Accordingly, each electrically conductive element 202 is in contact with one another at their respective sides to insure an electrically conductive path between electrically conductive elements 202.

Any trimming of upper composite skin 204, lower composite skin 206, and/or electrically conductive elements 202 may then be performed after the curing process, which completes the forming of array structure 200. Array structure 200 may then be further fabricated as a portion of wing 102 of aircraft 100.

Figure 4:
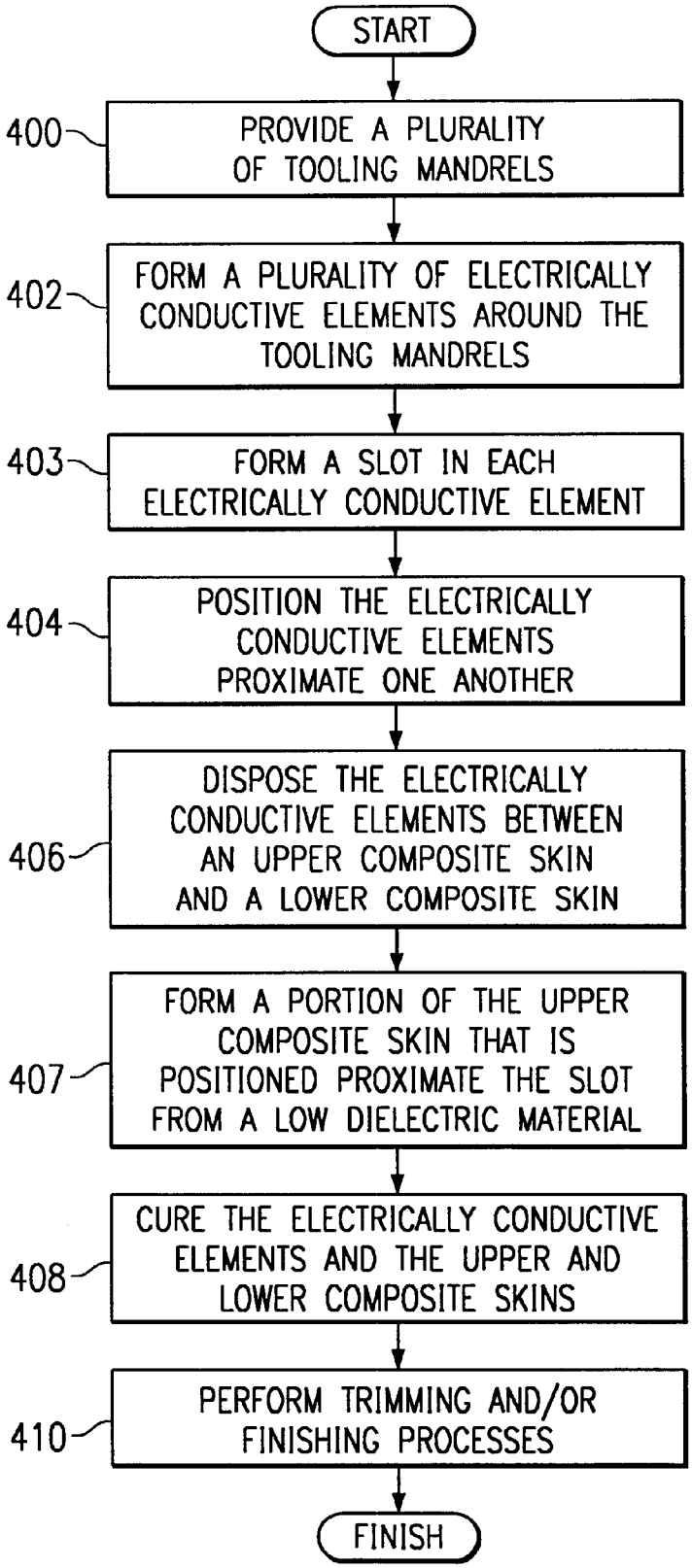
FIG. 4 is a flowchart illustrating one method for forming an end-fire cavity slot antenna array structure.

FIG. 4 is a flowchart illustrating one method of forming array structure 200. A plurality of tooling mandrels, such as cores 220, are provided at step 400. A plurality of electrically conductive elements 202 are formed around the tooling mandrels at step 402. As described above, electrically conductive elements 202 are formed from at least one sheet 221 of composite material having electrically conductive surface 222 configured such that electrically conductive surface 222 defines an inside surface of electrically conductive element 202 and any outside surfaces that are in contact with an adjacent electrically conductive element 202. A slot 218 is formed, as described above, in each electrically conductive element 202 at step 403. Once electrically conductive elements 202 and slot 218 are formed around the tooling mandrels, they are positioned, at step 404, proximate one another, as illustrated best in FIG. 2A. Electrically conductive elements 202 are then disposed, at step 406, between upper composite skin 204 and lower composite skin 206. A portion of upper composite skin 204 positioned proximate slot 218 is formed from a low dielectric material at step 407. The assembly at that point in the fabrication is then cured at step 408 so that the composite material may set. Any trimming or finishing processes are then performed at step 410 so that array structure 200 may be completed and be ready for incorporating into wing 102 of aircraft 100.

Although embodiments of the invention and their advantages are described in detail, a person skilled in the art could make various alterations, additions, and omissions without departing from the spirit and scope of the present invention as defined by the appended claims.

What is claimed is:

1. An end-fire cavity slot antenna array structure, comprising:

an upper skin formed from a composite material corresponding to a portion of an outer surface of an aircraft wing;

a lower skin formed from a composite material corresponding to a portion of an inner skin of the aircraft wing;

a plurality of proximately positioned electrically conductive elements disposed between the upper and lower skins; and wherein each electrically conductive element is formed from at least one sheet of composite material having an electrically conductive surface, the sheet of composite material configured such that the electrically conductive surface defines an inside surface of the electrically conductive element and any outside surfaces of the electrically conductive element that are in contact with an adjacent electrically conductive element.

2. The structure of claim 1, further comprising a plurality of radio frequency transparent cores, each radio frequency transparent core substantially defining the inner volume of each electrically conductive element.

3. The structure of claim 1, wherein each electrically conductive element includes a slot adjacent the upper skin, the slot having a pair of sidewall surfaces defined by the electrically conductive surface of the sheet of composite material.

4. The structure of claim 3, wherein a portion of the upper skin that is positioned proximate the slot is formed from a low dielectric material.

5. The structure of claim 1, wherein the electrically conductive elements have a curvature in at least one direction.

6. An aircraft, comprising:

a fuselage;

a wing coupled to the fuselage, the wing having an upper skin and a lower skin; and an end-fire cavity slot antenna array structure forming a portion of the upper skin and comprising:

an upper skin portion formed from a composite material;

a lower skin portion formed from a composite material;

a plurality of proximately positioned electrically conductive elements disposed between the upper skin portion and lower skin portion; and wherein each electrically conductive element is formed from at least one sheet of composite material having an electrically conductive surface, the sheet of composite material configured such that the electrically conductive surface defines an inside surface of the electrically conductive element and any outside surfaces of the electrically conductive element that are in contact with an adjacent electrically conductive element.

7. The aircraft of claim 6, further comprising a plurality of radio frequency transparent cores, each radio frequency transparent core substantially defining the inner volume of each electrically conductive element.

8. The aircraft of claim 6, wherein each electrically conductive element includes a slot adjacent the upper skin portion, the slot having a pair of sidewall surfaces defined by the electrically conductive surface of the sheet of composite material.

9. The aircraft of claim 8, wherein a portion of the upper skin portion that is positioned proximate the slot is formed from a low dielectric material.

10. The aircraft of claim 6, wherein the end-fire cavity slot antenna array structure has a curvature equal to a curvature of the upper skin of the wing.

11. A method of forming an end-fire cavity slot antenna array structure, comprising:

providing a plurality of tooling mandrels;

forming a plurality of electrically conductive elements around the tooling mandrels, the electrically conductive elements formed from at least one sheet of composite material having an electrically conductive surface configured such that the electrically conductive surface defines an inside surface of the electrically conductive element and any outside surfaces of the electrically conductive element that are in contact with an adjacent electrically conductive element;

positioning the electrically conductive elements proximate one another;

disposing the electrically conductive elements between an upper skin formed from a composite material and a lower skin formed from a composite material; and curing the electrically conductive elements and the upper and lower skins.

12. The method of claim 11, wherein providing the plurality of tooling mandrels comprises providing a plurality of radio frequency transparent cores, each radio frequency transparent core substantially defining the inner volume of each electrically conductive element.

13. The method of claim 11, further comprising forming a slot in each electrically conductive element, the slot adjacent the upper skin and having a pair of sidewall surfaces defined by the electrically conductive surface of the sheet of composite material.

14. The method of claim 13, further comprising forming a portion of the upper skin that is positioned proximate the slot from a low dielectric material.

15. The method of claim 11, further comprising forming the electrically conductive elements with a curvature in at least one direction.

* * * * *